US008433583B2

(12) United States Patent
Villemoes et al.

(10) Patent No.: US 8,433,583 B2
(45) Date of Patent: Apr. 30, 2013

(54) AUDIO DECODING

(75) Inventors: Lars Villemoes, Stockholm (SE); Erik Schuijers, Eindhoven (NL)

(73) Assignees: Koninklijke Philips International N.V., Eindhoven (NL); Dolby Sweden AB, Stockholm (SE)

( * ) Notice: Subject to any disclaimer, the term of this patent is extended or adjusted under 35 U.S.C. 154(b) by 1009 days.

(21) Appl. No.: 12/294,255

(22) PCT Filed: Mar. 23, 2007

(86) PCT No.: PCT/IB2007/051024
§ 371 (c)(1),
(2), (4) Date: May 22, 2009

(87) PCT Pub. No.: WO2007/110823
PCT Pub. Date: Oct. 4, 2007

(65) Prior Publication Data

US 2009/0240505 A1 Sep. 24, 2009

(51) Int. Cl.
*G10L 19/00* (2006.01)

(52) U.S. Cl.
USPC ..... 704/500

(58) Field of Classification Search ..... 704/500
See application file for complete search history.

(56) References Cited

U.S. PATENT DOCUMENTS

| | | | | |
|---|---|---|---|---|
| 5,706,309 | A | 1/1998 | Eberlein et al. | |
| 2003/0040822 | A1 | 2/2003 | Eid et al. | |
| 2005/0058304 | A1 | 3/2005 | Baumgarte et al. | |
| 2009/0290657 | A1 * | 11/2009 | Howard et al. | 375/267 |

FOREIGN PATENT DOCUMENTS

| | | | |
|---|---|---|---|
| EP | 1376538 | | 1/2004 |
| RU | 2129336 | C1 | 4/1999 |
| WO | WO2005/031704 | | 4/2005 |
| WO | WO2005/043511 | | 5/2005 |
| WO | 2007010451 | A1 | 1/2007 |

OTHER PUBLICATIONS

Breebaart et al., Parameteric Coding of Stereo Audio, 2005, EURASIP Journal on Applied Audio Signal Processing, pp. 1305-1322.*

Breebart, J. et al "MPEG Spatial Audio CodingMPEG Surround: Overview and Current Status" Audio Engineering Society, Oct. 2007, pp. 1-17.

Faller C. "Coding of Spatial Audio Compatible with Different Playback Formats" Audio Engineering Society, Oct. 2004, pp. 1-12.

Villemoes L. et al "MPEG Surround: The Forthcoming ISO Standard for Spatial Audio Coding" Proc. of the International AES Conf. Jun. 2006, pp. 1-18.

(Continued)

*Primary Examiner* — Jakieda Jackson

(74) *Attorney, Agent, or Firm* — Michael A. Glenn; Glenn Patent Group

(57) ABSTRACT

An audio decoder comprises a receiver (801) for receiving input data comprising an N-channel signal corresponding to a down-mixed signal of an M-channel audio signal, M>N, having complex valued subband encoding matrices applied in frequency subbands and parametric multi-channel data. A subband filter bank (805) generates real-valued frequency subbands for the N-channel signal. A matrix processor (809) determines real-valued subband decoding matrices for compensating the application of the encoding matrices in response to the parametric multi-channel data. A compensation processor (807) generates down-mix data corresponding to the down-mixed signal by a matrix multiplication of the real-valued subband decoding matrices and data of the N-channel signal in the at least some real-valued frequency subbands. The down-mix data can be used to regenerate the down-mixed signal and the M-channel audio signal. The decoder may compensate for MPEG Matrix Surround Compatibility operations performed at the encoder using real-valued frequency subbands.

20 Claims, 15 Drawing Sheets

OTHER PUBLICATIONS

Ten Kate, Warner R. TH: "Compatibility Matrixing of Multichannel Bit-Rate-Reduced Audio Signals" Journal of the Audio Engineering Society. vol. 44, No. 12, Dec. 1996, pp. 1104-1119.

Russian Decision on Grant (with English Translation), dated Dec. 8, 2010, in parallel Russian Patent Application No. 2008142752, 25 pages.

Breebart, et al., "MPEG Spatial Audio Coding/MPEG Surround: Overview and Current Status", Convention Paper 6599; Presented at the 119th Convention Oct. 7-10, 2005, New York, NY, USA, Audio Engineering Society, 1-17.

* cited by examiner

AUDIO DECODING

The invention relates to audio decoding and in particular, but not exclusively, to decoding of MPEG Surround signals.

Digital encoding of various source signals has become increasingly important over the last decades as digital signal representation and communication increasingly has replaced analogue representation and communication. For example, distribution of media content, such as video and music is increasingly based on digital content encoding.

Furthermore, in the last decade there has been a trend towards multi-channel audio and specifically towards spatial audio extending beyond conventional stereo signals. For example, traditional stereo recordings only comprise two channels whereas modern advanced audio systems typically use five or six channels, as in the popular 5.1 surround sound systems. This provides for a more involved listening experience where the user may be surrounded by sound sources.

Various techniques and standards have been developed for communication of such multi-channel signals. For example, six discrete channels representing a 5.1 surround system may be transmitted in accordance with standards such as the Advanced Audio Coding (AAC) or Dolby Digital standards.

However, in order to provide backwards compatibility, it is known to down-mix the higher number of channels to a lower number and specifically it is frequently used to down-mix a 5.1 surround sound signal to a stereo signal allowing a stereo signal to be reproduced by legacy (stereo) decoders and a 5.1 signal by surround sound decoders.

One example is the MPEG2 backwards compatible coding method. A multi-channel signal is down-mixed into a stereo signal. Additional signals are encoded as multi-channel data in the ancillary data portion allowing an MPEG2 multi-channel decoder to generate a representation of the multi-channel signal. An MPEG1 decoder will disregard the ancillary data and thus only decode the stereo down-mix. The main disadvantage of the coding method applied in MPEG2 is that the additional data rate required for the additional signals is in the same order of magnitude as the data rate required for coding the stereo signal. The additional bitrate for extending stereo to multi-channel audio is therefore significant.

Other existing methods for backwards-compatible multi-channel transmission without additional multi-channel information can typically be characterized as matrixed-surround methods. Examples of matrix surround encoding include methods such as Dolby Prologic II and Logic-7. The common principle of these methods is that they matrix-multiply the multiple channels of the input signal by a suitable matrix thereby generating an output signal with a lower number of channels. Specifically, a matrix encoder typically applies phase shifts to the surround channels prior to mixing them with the front and center channels.

Another reason for a channel conversion is coding efficiency. It has been found that e.g. surround sound audio signals can be encoded as stereo channel audio signals combined with a parameter bit stream describing the spatial properties of the audio signal. The decoder can reproduce the stereo audio signals with a very satisfactory degree of accuracy. In this way, substantial bit rate savings may be obtained.

There are several parameters which may be used to describe the spatial properties of audio signals. One such parameter is the inter-channel cross-correlation, such as the cross-correlation between the left channel and the right channel for stereo signals. Another parameter is the power ratio of the channels. In so-called (parametric) spatial audio (en)coders, such as the MPEG Surround encoder, these and other parameters are extracted from the original audio signal so as to produce an audio signal having a reduced number of channels, for example only a single channel, plus a set of parameters describing the spatial properties of the original audio signal. In so-called (parametric) spatial audio decoders, the spatial properties as described by the transmitted spatial parameters are re-instated.

Such spatial audio coding preferably employs a cascaded or tree-based hierarchical structure comprising standard units in the encoder and the decoder. In the encoder, these standard units can be down-mixers combining channels into a lower number of channels such as 2-to-1, 3-to-1, 3-to-2, etc. down-mixers, while in the decoder corresponding standard units can be up-mixers splitting channels into a higher number of channels such as 1-to-2, 2-to-3 up-mixers.

FIG. 1 illustrates an example of an encoder for coding multi-channel audio signals in accordance with the approach currently being standardized by MPEG under the name MPEG Surround. The MPEG Surround system encodes a multi-channel signal as a mono or stereo down-mix accompanied by a set of parameters. The down-mix signal can be encoded by a legacy audio coder, such as e.g. an MP3 or AAC encoder. The parameters represent the spatial image of the multi-channel audio signal and can be coded and embedded in a backward compatible fashion to the legacy audio stream.

On the decoder side, the core bit-stream is first decoded resulting in the mono or stereo down-mix signal being generated. Legacy decoders, i.e. decoders that do not make use of MPEG Surround decoding, can still decode this down-mix signal. If however an MPEG Surround decoder is available, the spatial parameters are reinstated resulting in a multi-channel representation which is perceptually close to the original multi-channel input signal. An example of an MPEG surround decoder is illustrated in FIG. 2.

Apart from the basic spatial encoding/decoding as illustrated in FIG. 1 and FIG. 2, the MPEG Surround system offers a rich set of features enabling a large application domain. One of the most prominent features is referred to as Matrix Compatibility or Matrix(ed) Surround Compatibility.

Examples of traditional matrix surround systems are Dolby Pro Logic I and II and Circle Surround. These systems operate as illustrated in FIG. 3. The multi-channel PCM input signal is transformed to a so-called matrixed down-mix signal using typically a 5(0.1) to 2 matrix. The idea behind matrix surround systems is that the front and the surround (rear) channels are mixed in-phase and out of phase respectively in the stereo down-mix signal. To some extent this allows inversion at the decoder side resulting in a multi-channel reconstruction.

In matrix surround systems the stereo signal can be transmitted using traditional channels intended for stereo transmission. Hence, similarly to the MPEG Surround system, matrix surround systems also offer a form of backward compatibility. However, due to specific phase properties of the stereo down-mix signal resulting from the matrix surround encoding, these signals often do not have a high sound quality when listened to as a stereo signal from e.g. loudspeakers or headphones.

In a matrix surround decoder an M to N (where e.g. M=2 and N=5(0.1)) matrix is applied to generate the multi-channel PCM output signal. However, in general an N to M matrix system, with (N>M) is not invertible, and thus matrix surround systems are generally not able to accurately reconstruct the original multi-channel PCM output signals which tend to have highly noticeable artefacts.

In contrast to such traditional matrix surround systems, Matrix Surround Compatibility in MPEG Surround is achieved by applying a 2×2 matrix to complex sample values in the frequency subbands of the MPEG Surround encoder following the MPEG surround encoding. An example of such an encoder is illustrated in FIG. 4. The 2×2 matrix is generally a complex valued matrix with coefficients dependent on the spatial parameters. In such a system, the spatial parameters are both time- and frequency-variant and consequently the 2×2 matrix is also both time- and frequency-variant. Accordingly, the complex matrix operation is typically applied to time-frequency tiles.

Applying the Matrix Surround Compatibility functionality in an MPEG surround encoder allows the resulting stereo signal to be compatible to the signal being generated by conventional matrix surround encoders, such as Dolby Pro-Logic™. This will allow legacy decoders to decode the surround signal. Furthermore, the operation of the Matrix Surround Compatibility can be reversed in a compatible MPEG Surround decoder thereby allowing a high quality multi-channel signal to be generated.

The matrix compatibility encoding matrix can described as following:

$$\begin{bmatrix} L_{MTX} \\ R_{MTX} \end{bmatrix} = H\begin{bmatrix} L \\ R \end{bmatrix} = \begin{bmatrix} h_{11} & h_{12} \\ h_{21} & h_{22} \end{bmatrix}\begin{bmatrix} L \\ R \end{bmatrix},$$

where L,R is the conventional MPEG stereo down mix, $L_{MTX}$, $R_{MTX}$ is the matrix-surround encoded down-mix and where $h_{xy}$ are the complex coefficients determined in response to the multi-channel parameters.

A major advantage of providing matrix compatible stereo signals by means of a 2×2 matrix is the fact that these matrices can be inverted. As a result, the MPEG Surround decoder can still deliver the same output audio quality regardless of whether or not a matrix compatible stereo down-mix is employed at the encoder. An example of a compatible MPEG surround decoder is illustrated in FIG. 5.

The inverse processing at the decoder side in a regular MPEG Surround decoder can thus be determined by:

$$\begin{bmatrix} L \\ R \end{bmatrix} = H^{-1}\begin{bmatrix} L_{MTX} \\ R_{MTX} \end{bmatrix} = \begin{bmatrix} h_{11,D} & h_{12,D} \\ h_{21,D} & h_{22,D} \end{bmatrix}\begin{bmatrix} L_{MTX} \\ R_{MTX} \end{bmatrix},$$

Thus, as H can be inverted, the operation of the matrix compatibility encoder can be reversed.

In the MPEG Surround system, the processing, including the matrix compatibility operations, take place in the frequency domain. More specifically so-called complex-exponential modulated Quadrature Mirror Filter (QMF) banks are employed to divide the frequency axis into a number of bands.

In many ways this type of QMF banks can be equated to the Overlap-Add Discrete Fourier Transform (DFT) bank, or its efficient counterpart the Fast Fourier Transform (FFT). The QMF bank as well as the DFT bank share the following desired properties for signal manipulation:

The frequency domain representation is oversampled. Due to this property it is possible to apply manipulations, such as e.g. equalization (scaling of individual bands) without introducing aliazing distortion. Critically sampled representations, such as e.g. the well-known Modified Discrete Cosine Transform (MDCT) which is e.g. employed in AAC do not obey this property. Hence, time- and frequency-variant modification of the MDCT coefficients prior to synthesis results in aliazing, which in turn causes audible artefacts in the output signal.

The frequency domain representation is complex-valued. In contrast to real-valued representations, complex-valued representations allow a simple modification of the phase of the signals.

Although there are a number of advantages over a critically-sampled real-valued representation in terms of signal manipulation, a significant disadvantage compared to such representation is the computational complexity. A major part of the complexity of the MPEG Surround decoder is due to the QMF analysis and synthesis filter banks and the corresponding processing on complex-valued signals.

Accordingly, it has been proposed to perform part of the processing in the real-valued domain for a so-called Low Power (LP) decoder. To that end, the complex-modulated filter bank has been replaced by a real-valued cosine modulated filter bank followed by a partial extension to the complex-valued domain for the lower frequency bands. Such a filter bank is illustrated in FIG. 6.

In the regular mode of operation, the MPEG Surround decoder applies real-valued processing to the complex-valued sub-band domain samples, or in case of LP, applies these to real-valued sub-band domain samples. However, the matrix compatibility feature in the decoder involves phase rotations in order to restore the original stereo down-mix in the frequency domain. These phase rotations are accomplished by means of complex-valued processing. In other words, the matrix compatibility decoding matrix $H^{-1}$ is inherently complex valued in order to introduce the required phase rotations. Accordingly, in such systems, the matrix surround compatible operation cannot be inverted in the real-valued part of the LP frequency domain representation leading to reduced decoding quality.

Hence, an improved audio decoding would be advantageous.

Accordingly, the Invention seeks to preferably mitigate, alleviate or eliminate one or more of the above mentioned disadvantages singly or in any combination.

According to a first aspect of the invention there is provided an audio decoder comprising: means for receiving input data comprising an N-channel signal corresponding to a down-mixed signal of an M-channel audio signal, M>N, having complex valued subband encoding matrices applied in frequency subbands and parametric multi-channel data associated with the down-mixed signal; means for generating frequency subbands for the N-channel signal, at least some of the frequency subbands being real-valued frequency subbands; determining means for determining real-valued subband decoding matrices for compensating the application of the encoding matrices in response to the parametric multi-channel data; means for generating down-mix data corresponding to the down-mixed signal by a matrix multiplication of the real-valued subband decoding matrices and data of the N-channel signal in the at least some real-valued frequency subbands.

The invention may allow improved and/or facilitated decoding. In particular, the invention may allow a substantial complexity reduction while achieving high audio quality. The invention may for example allow the effect of a complex valued subband matrix multiplication to be at least partially reversed at a decoder using real-valued frequency subbands.

As a specific example, the invention may e.g. allow MPEG Matrix Compatible encoding to be partially reversed in an MPEG surround decoder using real-valued frequency subbands The decoder may comprise means for generating the down-mixed signal in response to the down-mix data and may further comprise means for generating the M-channel audio signal in response to the down-mix data and the parametric multi-channel data. The invention may in such embodiments generate an accurate multi-channel audio signal at least partly based on real-valued frequency subbands.

A different decoding matrix may be determined for each frequency subband.

According to an optional feature of the invention, the determining means is arranged to determine complex valued subband inverse matrices of the encoding matrices and to determine the decoding matrices in response to the inverse matrices.

This may allow a particularly efficient implementation and/or improved decoding quality.

According to an optional feature of the invention, the determining means is arranged to determine each real-valued matrix coefficient of the decoding matrices in response to an absolute value of a corresponding matrix coefficient of the inverse matrices.

This may allow a particularly efficient implementation and/or improved decoding quality. Each real-valued matrix coefficient of the decoding matrices may be determined in response to an absolute value of only the corresponding matrix coefficient of the inverse matrices without consideration of any other matrix coefficient. A corresponding matrix coefficient may be a matrix coefficient in the same location of the inverse matrix for the same frequency subband.

According to an optional feature of the invention, the determining means is arranged to determine each real-valued matrix coefficient substantially as an absolute value of the corresponding matrix coefficient of the inverse matrices.

This may allow a particularly efficient implementation and/or improved decoding quality.

According to an optional feature of the invention, the determining means is arranged to determine the decoding matrices in response to subband transfer matrices being a multiplication of corresponding decoding matrices and encoding matrices.

This may allow a particularly efficient implementation and/or improved decoding quality. The corresponding decoding and encoding matrices may be encoding and decoding matrices for the same frequency subband. The determining means may in particular be arranged to select the coefficient values of the decoding matrices such that the transfer matrices have a desired characteristic.

According to an optional feature of the invention, the determining means is arranged to determine the decoding matrices in response to magnitude measures only of the transfer matrices.

This may allow a particularly efficient implementation and/or improved decoding quality. In particular, the determining means may be arranged to ignore phase measures when determining the decoding matrices. This may reduce complexity while maintaining low perceptible audio quality degradation.

According to an optional feature of the invention, the transfer matrices of each subband are given by $$P = \begin{bmatrix} p_{11} & p_{12} \\ p_{21} & p_{22} \end{bmatrix} = G \cdot H = \begin{bmatrix} g_{11} & g_{12} \\ g_{21} & g_{22} \end{bmatrix} \cdot \begin{bmatrix} h_{11} & h_{12} \\ h_{21} & h_{22} \end{bmatrix}$$

where G is a subband decoding matrix and H is a subband encoding matrix and the determining means is arranged to select the matrix coefficients $$\begin{bmatrix} g_{11} & g_{12} \\ g_{21} & g_{22} \end{bmatrix}$$

such that a power measure of $p_{12}$ and $p_{21}$ meets a criterion.

This may allow a particularly efficient implementation and/or improved decoding quality. The decoding matrix may be selected to result in a power measure below a threshold (which may be determined in response to constraints or other parameters) or may e.g. be selected as the decoding matrix resulting in the minimum power measure.

According to an optional feature of the invention, the magnitude measure is determined in response to $$|p_{12}^2|+|p_{21}^2|$$

This may allow a particularly efficient implementation and/or improved decoding quality.

According to an optional feature of the invention, the determining means is further arranged to select the matrix coefficients under the constraint of a magnitude of $p_{11}$ and $p_{22}$ being substantially equal to one.

This may allow a particularly efficient implementation and/or improved decoding quality.

According to an optional feature of the invention, the down-mixed signal and the parametric multi-channel data is in accordance with an MPEG surround standard.

The invention may allow a particularly efficient, low complexity and/or improved audio quality decoding for an MPEG surround compatible signal.

According to an optional feature of the invention, the encoding matrix is an MPEG Matrix Surround Compatibility encoding matrix and the first N-channel signal is an MPEG Matrix Surround Compatibility signal.

The invention may allow a particularly efficient, low complexity and/or improved audio quality and may in particular allow a low complexity decoding to efficiently compensate for MPEG Matrix Surround Compatibility operations performed at an encoder.

According to another aspect of the invention, there is provided a method of audio decoding, the method comprising: receiving input data comprising an N-channel signal corresponding to a down-mixed signal of an M-channel audio signal, M>N, having complex valued subband encoding matrices applied in frequency subbands and parametric multi-channel data associated with the down-mixed signal; generating frequency subbands for the N-channel signal, at least some of the frequency subbands being real-valued frequency subbands; determining real-valued subband decoding matrices for compensating the application of the encoding matrices in response to the parametric multi-channel data; and generating down-mix data corresponding to the down-mixed signal by a matrix multiplication of the real-valued subband decoding matrices and data of the N-channel signal in the at least some real-valued frequency subbands.

According to another aspect of the invention, there is provided a receiver for receiving an N-channel signal, the receiver comprising: means for receiving input data comprising an N-channel signal corresponding to a down-mixed signal of an M-channel audio signal, M>N, having complex valued subband encoding matrices applied in frequency subbands and parametric multi-channel data associated with the down-mixed signal; means for generating frequency subbands for the N-channel signal, at least some of the frequency subbands being real-valued frequency subbands; determining means for determining real-valued subband decoding matrices for compensating the application of the encoding matrices in response to the parametric multi-channel data; means for generating down-mix data corresponding to the down-mixed signal by a matrix multiplication of the real-valued subband decoding matrices and data of the N-channel signal in the at least some real-valued frequency subbands.

According to another aspect of the invention, there is provided a transmission system for transmitting an audio signal, the transmission system comprising: a transmitter comprising: means for generating an N-channel down-mixed signal of an M-channel audio signal, M>N, means for generating parametric multi-channel data associated with the down-mixed signal, means for generating a first N-channel signal by applying complex valued subband encoding matrices to the N-channel down-mixed signal in frequency subbands, means for generating a second N-channel signal comprising the first N-channel signal and the parametric multi-channel data, and means for transmitting the second N-channel signal to a receiver; and the receiver comprising: means for receiving the second N-channel signal, means for generating frequency subbands for the first N-channel signal, at least some of the frequency subbands being real-valued frequency subbands, determining means for determining real-valued subband decoding matrices for compensating the application of the encoding matrices in response to the parametric multi-channel data, and means for generating down-mix data corresponding to the N-channel down-mixed signal by a matrix multiplication of the real-valued subband decoding matrices and data of the N-channel signal in the at least some real-valued frequency subbands.

The second N channel signal may have an additional associated channel comprising the parametric multi-channel data.

According to another aspect of the invention, there is provided a method of receiving an audio signal from a scalable audio bit-stream, the method comprising: receiving input data comprising an N-channel signal corresponding to a down-mixed signal of an M-channel audio signal, M>N, having complex valued subband encoding matrices applied in frequency subbands and parametric multi-channel data associated with the down-mixed signal; generating frequency subbands for the N-channel signal, at least some of the frequency subbands being real-valued frequency subbands; determining real-valued subband decoding matrices for compensating the application of the encoding matrices in response to the parametric multi-channel data; and generating down-mix data corresponding to the down-mixed signal by a matrix multiplication of the real-valued subband decoding matrices and data of the N-channel signal in the at least some real-valued frequency subbands.

According to another aspect of the invention, there is provided a method of transmitting and receiving an audio signal, the method comprising: at a transmitter performing the steps of: generating an N-channel down-mixed signal of an M-channel audio signal, M>N, generating parametric multi-channel data associated with the down-mixed signal, generating a first N-channel signal by applying complex valued subband encoding matrices to the N-channel down-mixed signal in frequency subbands, generating a second N-channel signal comprising the first N-channel signal and the parametric multi-channel data, and transmitting the second N-channel signal to a receiver; and at the receiver performing the steps of: receiving the second N-channel signal; generating frequency subbands for the first N-channel signal, at least some of the frequency subbands being real-valued frequency subbands; determining real-valued subband decoding matrices for compensating the application of the encoding matrices in response to the parametric multi-channel data; generating down-mix data corresponding to the N-channel down-mixed signal by a matrix multiplication of the real-valued subband decoding matrices and data of the N-channel signal in the at least some real-valued frequency subbands.

These and other aspects, features and advantages of the invention will be apparent from and elucidated with reference to the embodiment(s) described hereinafter.

Embodiments of the invention will be described, by way of example only, with reference to the drawings, in which FIG. 1 illustrates an example of an encoder for coding multi-channel audio signals in accordance with prior art;

The following description focuses on embodiments of the invention applicable to a decoder for decoding an MPEG surround encoded signal including a Matrix Surround Compatibility encoding. However, it will be appreciated that the invention is not limited to this application but may be applied to many other encoding standards.

Figure 7:
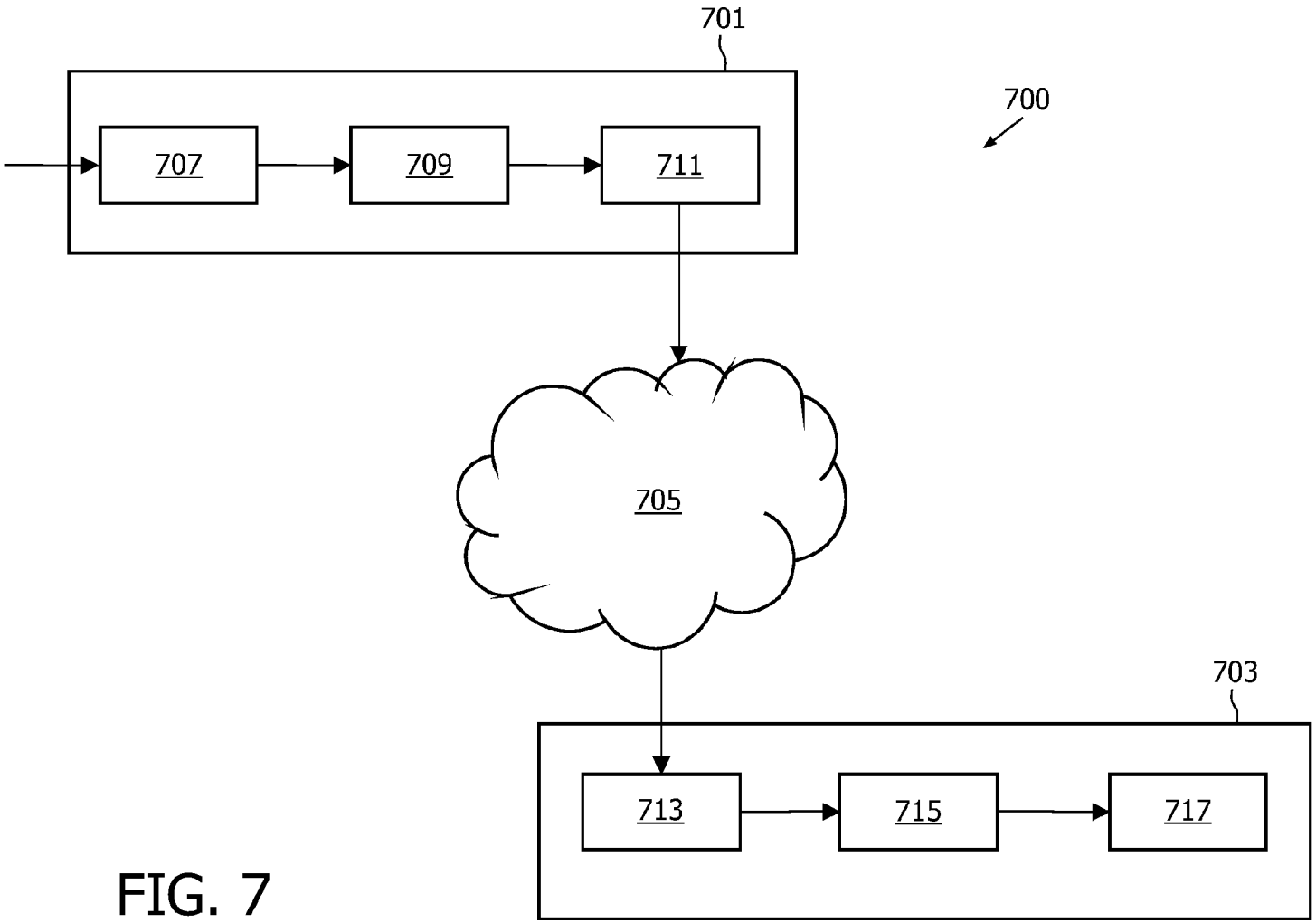
FIG. 7 illustrates a transmission system for communication of an audio signal in accordance with some embodiments of the invention.

FIG. 7 illustrates a transmission system 700 for communication of an audio signal in accordance with some embodiments of the invention. The transmission system 700 comprises a transmitter 701 which is coupled to a receiver 703 through a network 705 which specifically may be the Internet.

In the specific example, the transmitter 701 is a signal recording device and the receiver 703 is a signal player device but it will be appreciated that in other embodiments a transmitter and receiver may used in other applications and for other purposes.

In the specific example where a signal recording function is supported, the transmitter 701 comprises a digitizer 707 which receives an analog multi-channel signal that is converted to a digital PCM (Pulse Coded Modulated) multi-channel signal by sampling and analog-to-digital conversion.

Figure 1:
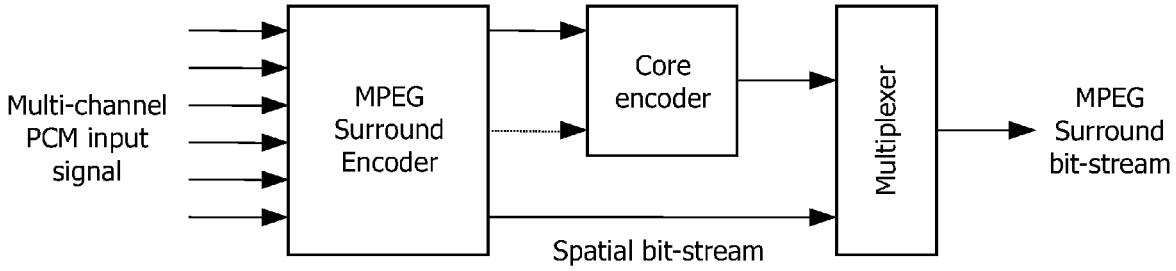
FIG. 1 Prior Art
Figure 2:
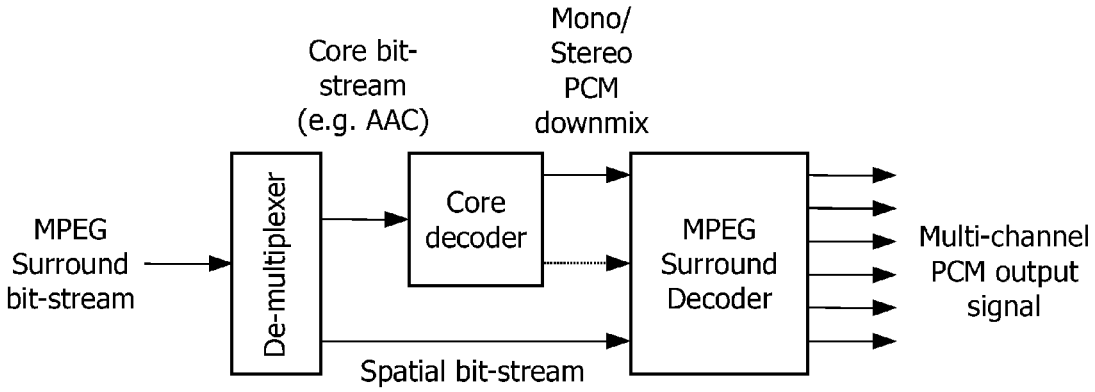
FIG. 2 Prior Art
FIG. 2 illustrates an example of a decoder for decoding multi-channel audio signals in accordance with prior art.
Figure 3:
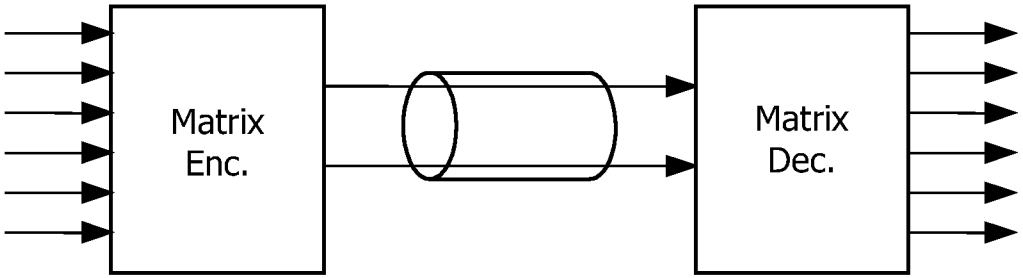
FIG. 3 Prior Art
FIG. 3 illustrates an example of a matrix surround encoding/decoding system in accordance with prior art.
Figure 4:
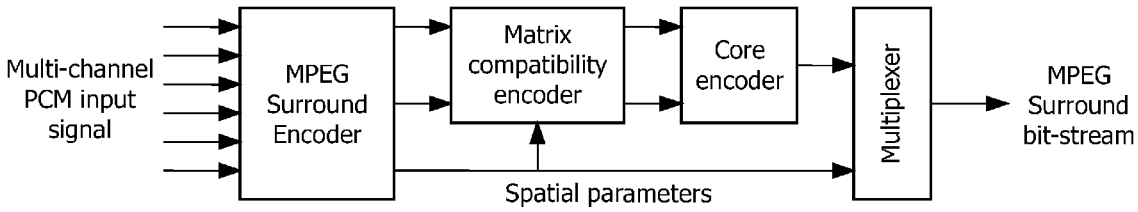
FIG. 4 Prior Art
FIG. 4 illustrates an example of an encoder for coding multi-channel audio signals in accordance with prior art.
Figure 5:
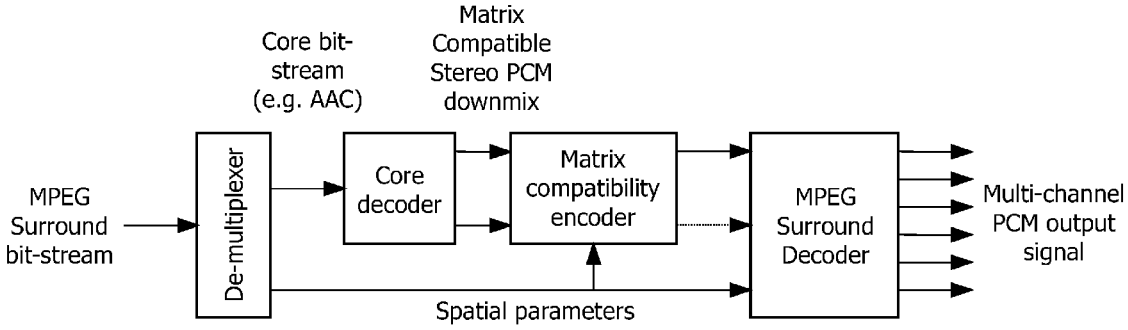
FIG. 5 Prior Art
FIG. 5 illustrates an example of a decoder for decoding multi-channel audio signals in accordance with prior art.

The transmitter 701 is coupled to the encoder 709 of FIG. 1 which encodes the PCM signal in accordance with an MPEG Surround encoding algorithm which includes functionality for Matrix Surround Compatibility encoding. The encoder 709 may for example be the prior art decoder of FIG. 4. In the example, the encoder 709 specifically generates a stereo MPEG Matrix Surround Compatible stereo down-mixed signal.

Thus, the encoder 709 generates a signal given by $$\begin{bmatrix} L_{MTX} \\ R_{MTX} \end{bmatrix} = H\begin{bmatrix} L \\ R \end{bmatrix} = \begin{bmatrix} h_{11} & h_{12} \\ h_{21} & h_{22} \end{bmatrix}\begin{bmatrix} L \\ R \end{bmatrix},$$

where L,R is a conventional MPEG surround stereo down mix and $L_{MTX}$, $R_{MTX}$ is the matrix surround compatible encoded down-mix output by the encoder 709. In addition, the signal generated by the encoder 709 comprises multi-channel parametric data generated by the MPEG surround encoding. Furthermore, $h_{xy}$ are complex coefficients determined in response to the multi-channel parameters. As will be readily understood by the person skilled in the art, the processing performed by the encoder 709 is performed in complex valued subbands and using complex operations.

The encoder 709 is coupled to a network transmitter 711 which receives the encoded signal and interfaces to the network 705. The network transmitter 711 may transmit the encoded signal to the receiver 703 through the network 705.

The receiver 703 comprises a network interface 713 which interfaces to the network 705 and which is arranged to receive the encoded signal from the transmitter 701.

The network interface 713 is coupled to a decoder 715. The decoder 715 receives the encoded signal and decodes it in accordance with a decoding algorithm. In the example, the decoder 715 regenerates the original multi-channel signal. Specifically, the decoder 715 first generates a compensated stereo down-mix corresponding to the down-mix generated by the MPEG surround encoding prior to the MPEG matrix surround compatible operations being performed. A decoded multi-channel signal is then generated from this down-mix and the received multi-channel parametric data.

In the specific example where a signal playing function is supported, the receiver 703 further comprises a signal player 717 which receives the decoded multi-channel audio signal from the decoder 715 and presents this to the user. Specifically, the signal player 717 may comprise a digital-to-analog converter, amplifiers and speakers as required for outputting the decoded audio signal.

Figure 8:
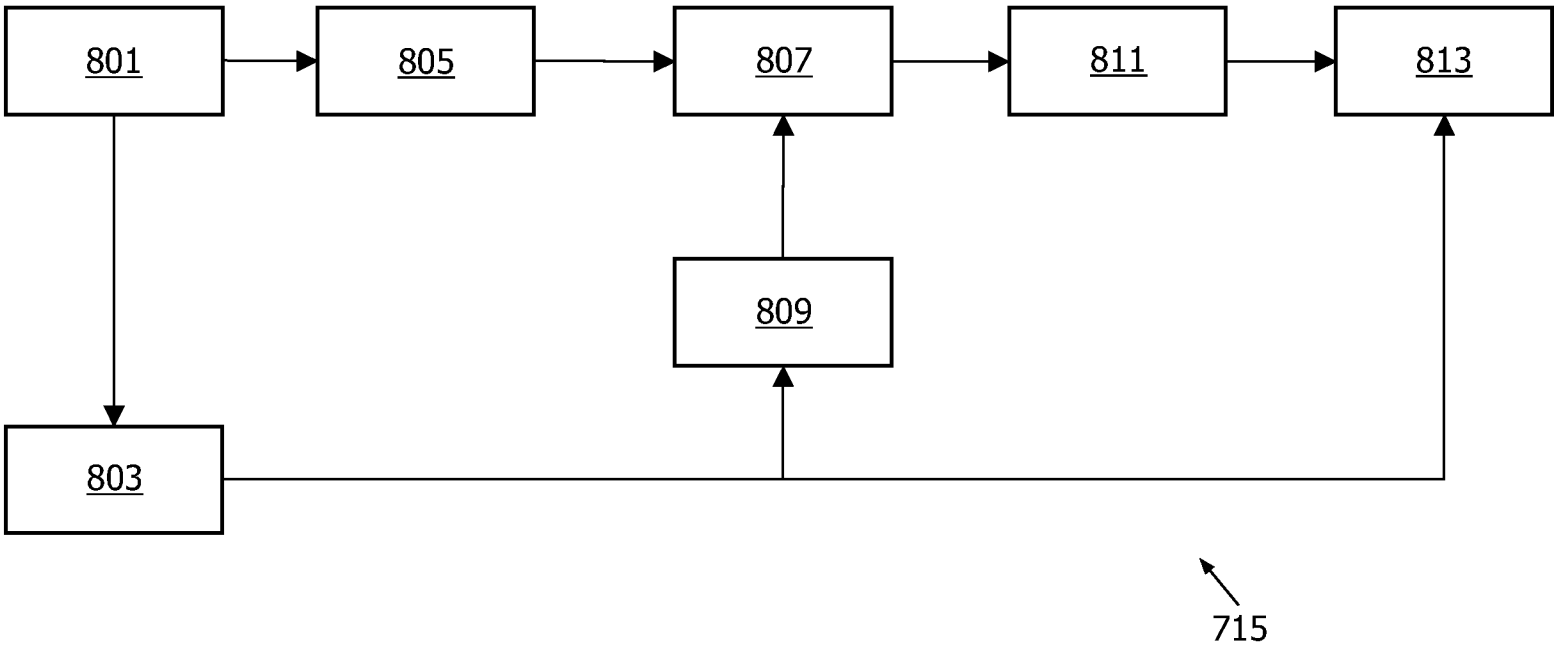
FIG. 8 illustrates a decoder in accordance with some embodiments of the invention.

FIG. 8 illustrates the decoder 715 in more detail.

The decoder 715 comprises the receiver 801 which receives the signal generated by the encoder 709. As mentioned previously, the signal is a stereo signal which corresponds to a down-mix signal that has been processed by the complex sample values in complex valued frequency subbands being multiplied by a complex valued encoding matrix H. In addition, the received signal comprises multi-channel parametric data which corresponds to the down-mix signal. Specifically, the received signal is an MPEG surround encoded signal with matrix surround compatibility processing.

The receiver 801 furthermore provides the core decoding of the received signal to generate the down-mixed PCM signal.

The receiver 801 is coupled to a parametric data processor 803 which extracts the multi-channel parametric data from the received signal.

Figure 6:
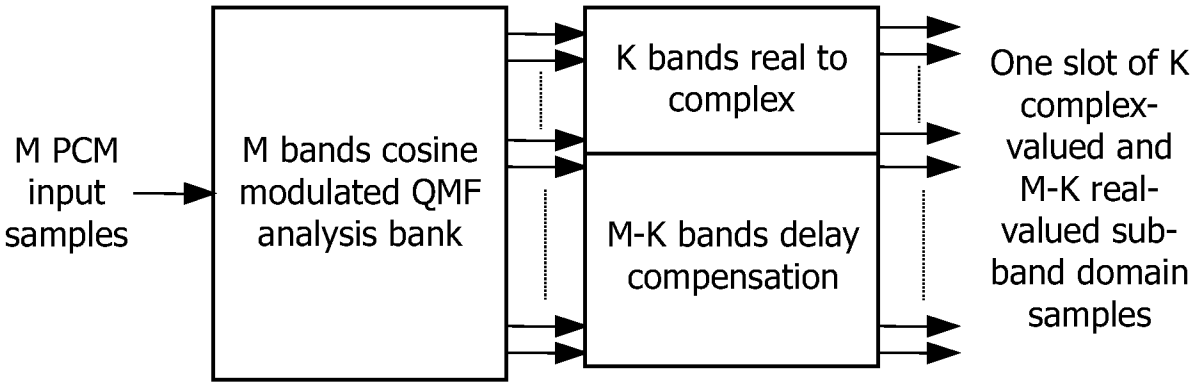
FIG. 6 illustrates an example of a filter bank for generating complex and real-valued frequency subbands.

The receiver 801 is furthermore coupled to a subband filter bank 805 which transforms the received stereo signal to the frequency domain. Specifically, the subband filter bank 805 generates a plurality of the frequency subbands. At least some of these frequency subbands are real-valued frequency subbands. The subband filter bank 805 may specifically correspond to the functionality illustrated in FIG. 6. Thus, the subband filter bank 805 may generate K complex valued subbands and M-K. real-valued subbands. The real-valued subbands will typically be the higher frequency subbands, such as the subbands above 2 kHz. The use of real-valued subbands substantially facilitates subband generation as well as the operations performed on the samples in these subbands. Thus, in the decoder 715 M-K subbands are processed as real-valued data and operations rather than as complex-valued data and operations thereby providing a substantial complexity and cost reduction.

The subband filter bank 805 is coupled to a compensation processor 807 which generates down-mix data corresponding to the down-mixed signal. Specifically, the compensation processor 807 compensated for the matrix surround compatibility operation by seeking to reverse the multiplication by the encoding matrix H in the frequency subbands of the encoder 709. This compensation is performed by multiplying the data values of the subbands by a subband decoding matrix G. However, in contrast to the processing at the encoder 709, the matrix multiplication in the real-valued subbands of the decoder 715 are performed exclusively in the real domain. Thus, not only are the sample values real-valued samples but the matrix coefficients of the decoding matrix G are also real-valued coefficients.

The compensation processor 807 is coupled to a matrix processor 809 which determines the decoding matrices to be applied in the subbands. For the M complex valued subbands, the decoding matrix G can simply be determined as the inverse of the encoding matrix H in the same subband. However, for the real-valued subbands the matrix processor 809 determines real-valued matrix coefficients that may provide an efficient compensation for the encoding matrix operation.

Thus, the output of the compensation processor 807 corresponds to the subband representation of the MPEG surround encoded down-mix signal. Accordingly, the effect of the matrix surround compatibility operations can be substantially reduced or removed.

The compensation processor 807 is coupled to a synthesis subband filter bank 811 which generates a time domain PCM MPEG surround decoded down-mix signal from the subband representation. In the specific example, synthesis subband filter bank 811 thus forms the counterpart of the subband filter bank 805 in converting the signal back to the time domain.

The synthesis subband filter bank 811 is fed to a multi-channel decoder 813 which is furthermore coupled to the parametric data processor 803. The multi-channel decoder 813 receives the time domain PCM down-mix signal and the multi-channel parametric data and generates the original multi-channel signal.

In the example, the synthesis subband filter bank 811 transforms the subband signal on which the matrix operations have been performed to the time domain. The multi-channel decoder 813 thus receives an MPEG surround encoded signal comparable to one that would have been received if no matrix surround compatible operations had been applied at the decoder. Thus, the same MPEG multi-channel decoding algorithm can be used for matrix surround compatible signals and for non-matrix surround compatible signals. However, in other embodiments, the multi-channel decoder 813 may directly operate on the subband samples following compensation by the compensation processor 807. In such cases, the synthesis subband filter bank 811 may be omitted or some of the functionality of the synthesis subband filter bank 811 may be integrated with the multi-channel decoder 813.

Thus, in order to reduce complexity it is often preferable to stay in the sub-band domain when providing the compensated signal to the multi-channel decoder 813. As such it is possible to avoid the complexity of the synthesis subband filter bank 811 and the analysis filter banks which are part of the multi-channel decoder 813.

Indeed if possible, it is typically preferred not to move back and forth between the frequency domain and the time domain as this is computationally expensive. Hence, in some decoders in accordance with some embodiments of the invention, after the signals have been converted to the sub-band (frequency) domain (which on its turn have been determined by decoding the core bit-stream and applying the filterbanks to the resulting PCM signals), the matrix surround inversion is applied in the compensation processor 807 (if applicable, i.e., if signaled in the bit-stream) and then the resulting sub-band domain signals are directly used to reconstruct the multi-channel (sub-band domain) signals. Finally the synthesis filter banks are applied to obtain the time-domain multi-channel signals.

Thus, in the system of FIG. 7, the encoder 709 can generate a matrix surround compatible signal which can be decoded by legacy matrix surround decoders such as Dolby Pro Logic™ decoders. Although this requires a distortion of the original MPEG surround encoded down-mix signal by a matrix surround compatibility operation, this operation can be effectively removed in an MPEG multi-channel decoder thereby allowing an accurate representation of the original multi-channel to be generated using the parametric data.

Furthermore, the decoder 715 allows the compensation for the matrix surround compatibility operation to be performed in real-valued frequency subbands rather than requiring complex-valued frequency subbands thereby substantially reducing the complexity of the decoder 715 while achieving high audio quality.

In the following, examples of the determination of suitable matrix coefficients for the decoding matrices will be described.

The encoder 709 performs the matrix surround compatibility operation by applying the following complex-valued encoding matrix in each subband (it will be appreciated that each subband has a different encoding matrix):

$$\begin{bmatrix} L_{MTX} \\ R_{MTX} \end{bmatrix} = H\begin{bmatrix} L \\ R \end{bmatrix} = \begin{bmatrix} h_{11} & h_{12} \\ h_{21} & h_{22} \end{bmatrix}\begin{bmatrix} L \\ R \end{bmatrix},$$

where L,R is the conventional stereo down mix, and $L_{MTX}$, $R_{MTX}$ is the matrix-surround encoded down mix. The encoder matrix H is given by:

$$h_{11} = \frac{1 - w_1 + jw_1}{\sqrt{1 - 2w_1 + 2w_1^2}},$$

$$h_{22} = \frac{1 - w_2 - jw_2}{\sqrt{1 - 2w_2 + 2w_2^2}},$$

$$h_{12} = \frac{jw_2}{\sqrt{3(1 - 2w_2 + 2w_2^2)}},$$

-continued $$h_{21} = \frac{-jw_1}{\sqrt{3(1 - 2w_1 + 2w_1^2)}}.$$

where $w_1$ and $w_2$ depend on the spatial parameters generated by the MPEG surround encoding. Specifically:

$$w_1 = \frac{w_{1,t}}{\sqrt{1 - 2w_{1,t} + 2w_{1,t}^2}},$$

$$w_2 = \frac{w_{2,t}}{\sqrt{1 - 2w_{2,t} + 2w_{2,t}^2}},$$

where $w_{1,t}$ and $w_{2,t}$ are the non-normalized weights, which are defined as:

$$w_{1,t} = \frac{c_{1,MTX} \cdot 10^{-\frac{CLD_l}{20}}}{1 + 10^{-\frac{CLD_l}{20}}},$$

$$w_{2,t} = \frac{c_{2,MTX} \cdot 10^{-\frac{CLD_r}{20}}}{1 + 10^{-\frac{CLD_r}{20}}}$$

where $CLD_l$ and $CLD_r$ represent the channel level differences (expressed in dB) of the left-front, left-surround and right-front, right-surround channel pairs respectively. $c_{1,MTX}$ and $c_{2,MTX}$ are the matrix coefficients which are a function of the prediction coefficients $c_1$ and $c_2$ used to derive the intermediate left L, center C and right R signals from the left $L_{DMX}$ and right $R_{DMX}$ downmix signals in the decoder as following:

$$\begin{bmatrix} L \\ R \\ C \end{bmatrix} = \begin{bmatrix} c_1 + 2 & c_2 - 1 \\ c_1 - 1 & c_2 + 2 \\ 1 - c_1 & 1 - c_2 \end{bmatrix}\begin{bmatrix} L_{DMX} \\ R_{DMX} \end{bmatrix}.$$

$c_{1,MTX}$ and $c_{2,MTX}$ are determined as:

$$c_{x,MTX} = \begin{cases} -1 - 2c_x & \text{if } -1 \le c_x < -0.5 \\ 1/3 + 2c_x/3 & \text{if } -0.5 \le c_x < 1 \\ 1 & \text{elsewhere,} \end{cases}$$

with x={0,1} respectively.

Alternatively, the MPEG surround decoder supports a mode where the coefficients $c_1$ and $c_2$ represent power ratios of left versus left plus center and right versus right plus center respectively. In that case different functions for $c_{1,MTX}$ and $c_{2,MTX}$ apply.

Thus, for each time/frequency tile, a complex valued encoding matrix H is applied to complex sample values. If the front signals were dominant in the original multi-channel input signal, the weights $w_1$ and $w_2$ would be close to zero. As a result the matrix surround down-mix would be close to the input stereo down-mix. If the surround (rear) signals were dominant in the original multi-channel input signal, the weights $w_1$ and $w_2$ would be close to one. As a result the matrix surround down-mix signal would contain a highly out-of-phase version of the original stereo down-mix provided by the MPEG Surround encoder.

A major advantage of providing matrix compatible stereo signals by means of a 2×2 matrix is the fact that these matrices can be inverted. As a result, the MPEG Surround decoder can still deliver the same output audio quality regardless of whether or not a matrix compatible stereo down-mix was employed by the encoder.

The inverse processing at the decoder side in an MPEG Surround decoder where all frequency subbands are complex-valued subbands (e.g. using a complex-modulated QMF bank) is then given by:

$$\begin{bmatrix} L \\ R \end{bmatrix} = H^{-1}\begin{bmatrix} L_{MTX} \\ R_{MTX} \end{bmatrix} = \begin{bmatrix} h_{11,D} & h_{12,D} \\ h_{21,D} & h_{22,D} \end{bmatrix}\begin{bmatrix} L_{MTX} \\ R_{MTX} \end{bmatrix},$$

with $$h_{11,D} = \frac{h_{22}}{N},$$

$$h_{22,D} = \frac{h_{11}}{N},$$

$$h_{12,D} = \frac{-h_{12}}{N},$$

$$h_{21,D} = \frac{-h_{21}}{N},$$

where $$N = h_{11}h_{22} - h_{12}h_{21}.$$

However, such an inverse operation requires that complex values are used and therefore cannot be applied in the decoder 715 of FIG. 7 as this (at least partly) uses real-valued subbands. Accordingly, the matrix processor 809 generates a real-valued decoding matrix that can be applied to significantly reduce of the effect of the encoding matrix.

The overall impact of the encoding and decoding matrices in each subband can be represented by the transfer matrix P given as $$P = \begin{bmatrix} p_{11} & p_{12} \\ p_{21} & p_{22} \end{bmatrix} = G \cdot H = \begin{bmatrix} g_{11} & g_{12} \\ g_{21} & g_{22} \end{bmatrix} \cdot \begin{bmatrix} h_{11} & h_{12} \\ h_{21} & h_{22} \end{bmatrix},$$

where H represents the encoder matrix and G represents the decoder matrix.

Ideally $G=H^{-1}$, such that: $P=H^{-1}\cdot H=I$, the unity matrix. Due to the fact that the weights $h_{xy}$ of the encoder matrix H are all complex-valued, the matrix can not be inverted in the decoder for the real-valued subbands.

The real-valued subbands are typically at higher frequencies such as the subbands above 2 kHz. At these frequencies, the phase relationships are perceptually much less important and therefore the matrix processor 809 determines decoding matrix coefficients that have suitable magnitude (power) characteristics without consideration of the phase characteristics. Specifically, the matrix processor 809 can determine real-valued matrix coefficients that will result in a low magnitude or power value of the crosstalk terms $P_{12}$ and $p_{21}$ under the assumption or constraint that $|p_{11}|\approx 1$ and $|p_{22}|\approx 1$.

In some embodiments, the matrix processor 809 can determine the complex valued subband inverse matrix $H^{-1}$ of the encoding matrices and can then determine the real-valued decoding matrix G from the matrix coefficients of this matrix. Specifically, each coefficient of G can be determined from the coefficient of $H^{-1}$ which is at the same location. For example, a real-valued coefficient can be determined from the magnitude value of the corresponding coefficient of $H^{-1}$. Indeed, in some embodiments, the matrix processor can determine the coefficients of $H^{-1}$ and subsequently determine the coefficients of G as the absolute value of the corresponding matrix coefficient of the inverse matrix $H^{-1}$.

Thus, the matrix processor 809 can determine $$G = \begin{bmatrix} g_{11} & g_{12} \\ g_{21} & g_{22} \end{bmatrix}$$

$$g_{11} = h_{11,D} = \frac{1}{|N|},$$

$$g_{12} = h_{12,D} = \frac{w_2}{\left|N\right|\sqrt{3(1-2w_2+2w_2^2)}},$$

$$g_{21} = h_{21,D} = \frac{w_1}{\left|N\right|\sqrt{3(1-2w_1+2w_1^2)}},$$

$$g_{22} = h_{22,D} = \frac{1}{|N|}.$$

where $$N = h_{11}h_{22} - h_{12}h_{21}.$$

as

It can be shown that this solution perfectly satisfies the constraints mentioned above ($|p_{11}|=|p_{22}|=1$ and $|p_{12}|=|p_{21}|=0$) for the specific cases of $w_1=w_2=0$ and $w_1=w_2=1$.

Figure 9:
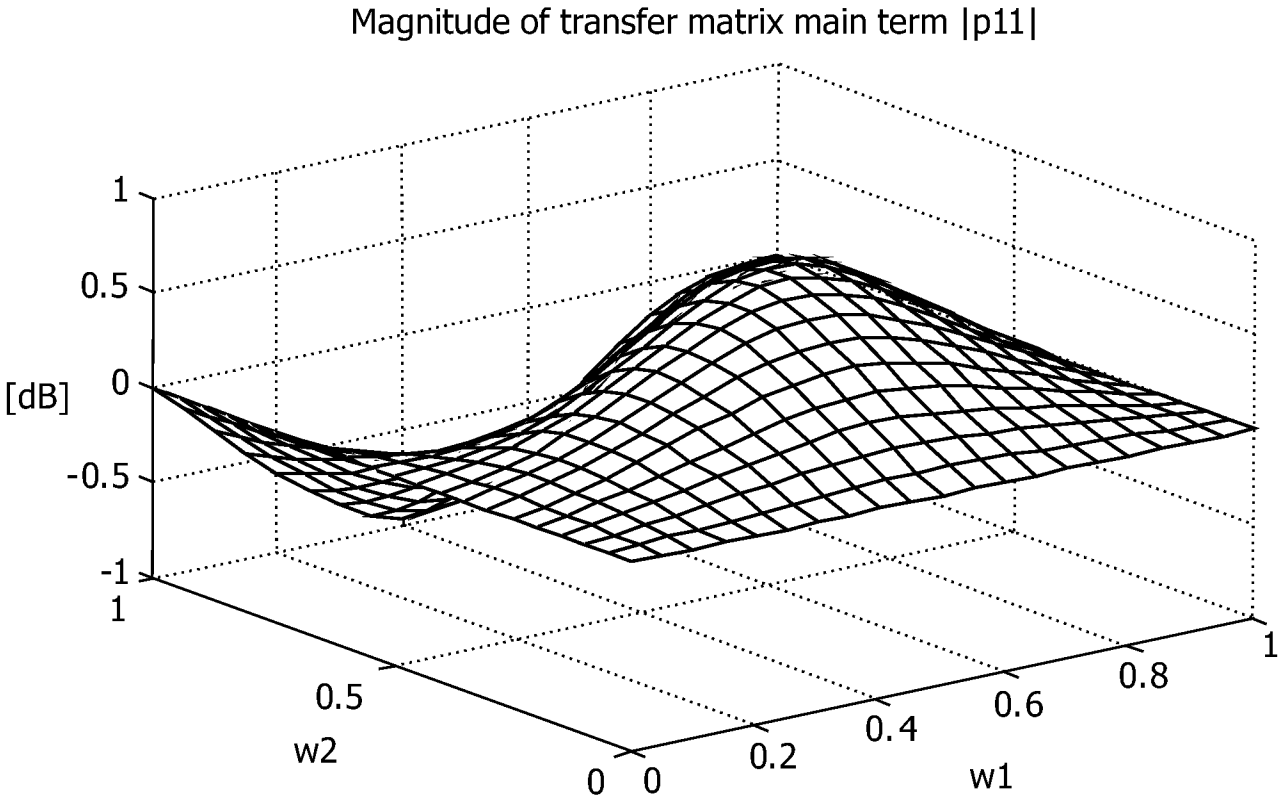
FIGS. 9-14 illustrates performance characteristics for a decoder in accordance with some embodiments of the invention.
Figure 10:
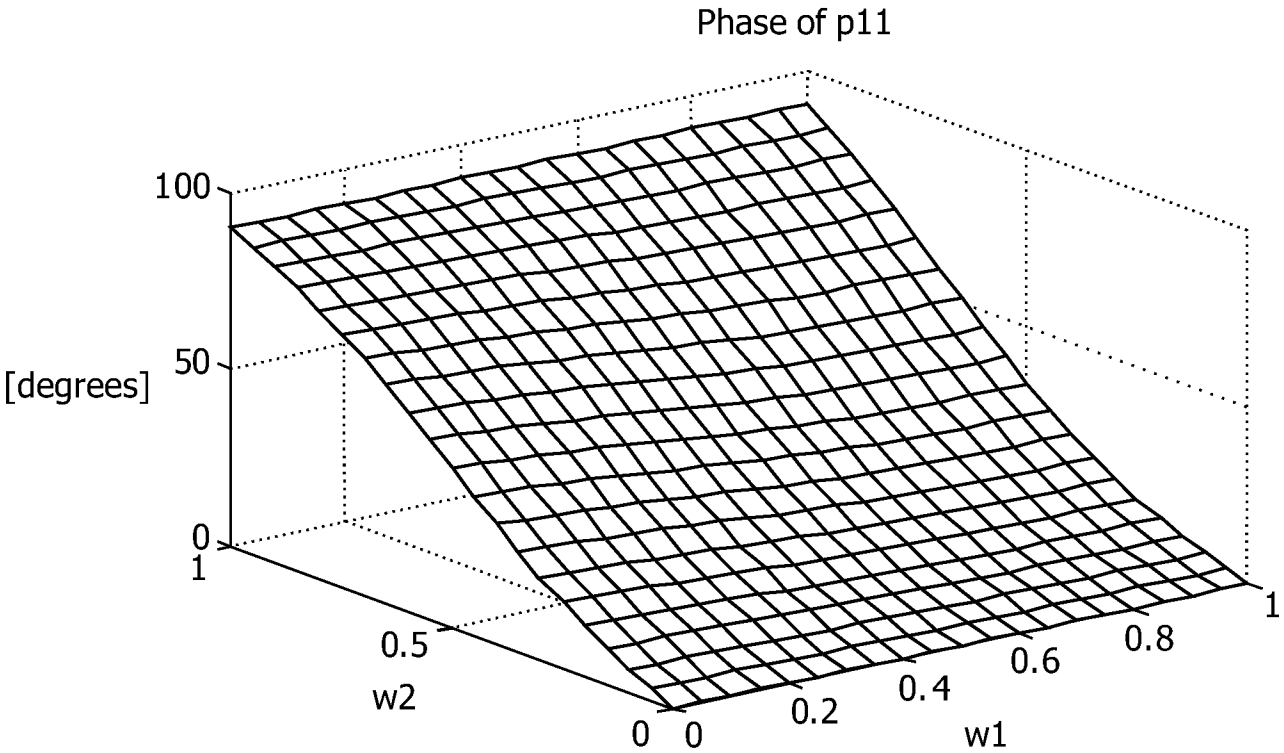

FIG. 9 illustrates the magnitude of transfer matrix main term ($10\log_{10}|p_{11}|^2$) for this solution. FIG. 10 illustrates the phase angle of $p_{11}$ and FIG. 11 the crosstalk term ($10\log_{10}|p_{21}|^2$).

Figure 11:
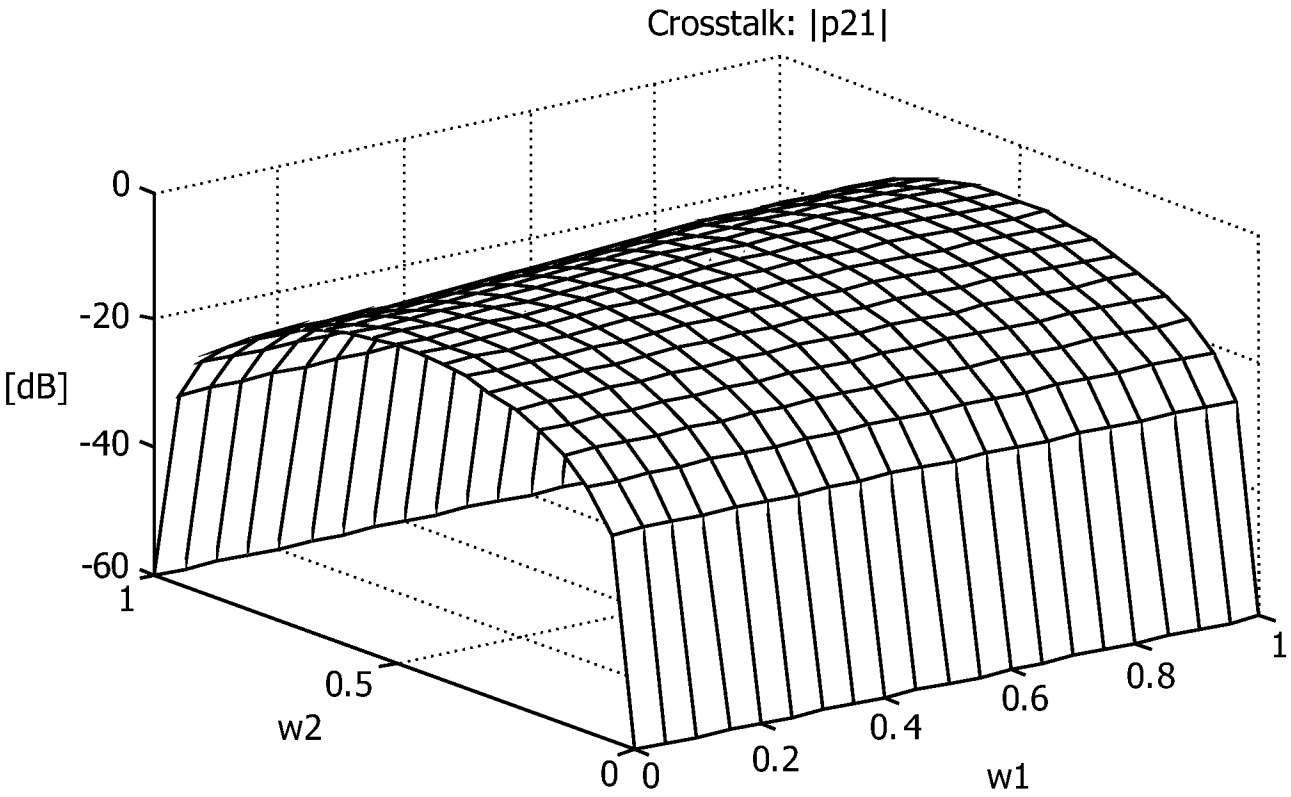

Specifically FIG. 9 shows the deviation in dB of the magnitude of the main matrix term $p_{11}$ relative to the ideal value of $|p_{11}|=1$ as a function of $w_1$ and $w_2$. As can be observed, the maximum deviation from the ideal case is less than 1 dB. FIG. 10 shows the angle of $p_{11}$ as a function of $w_1$ and $w_2$. As can be expected from the difference with respect to the ideal complex-valued case, phase differences are up to 90 degrees. FIG. 11 shows the magnitude of the crosstalk matrix term $P_{21}$ measured in dB as a function of weights $w_1$ and $w_2$. It should be noted that the other transfer matrix elements can be obtained by interchanging $w_1$ and $w_2$.

In some embodiments, the matrix processor 809 can determine the decoding matrix G for a subband in response to the subband transfer matrix $P=G\cdot H$. Specifically, the matrix processor can select coefficient values of G such that a given characteristic is achieved for P.

Again, as the phase values for the real-valued subbands tend to have low perceptual weighting, only the magnitude characteristics of P are considered by the exemplary decoder 715. High quality performance can be achieved by the matrix processor 809 selecting the decoding matrix coefficients such that a power measure of $p_{12}$ and $p_{21}$ meets a criterion—such as for example that the power measure is minimized or that the power measure is below a given criterion. The matrix processor 809 may for example search over a range of possible real-valued coefficients and select the ones that result in the lowest power measure for $p_{12}$ and $p_{21}$. Furthermore, the evaluation may be subject to other constraints, such as a constraint that $p_{11}$ and $p_{22}$ are substantially equal to one (e.g. between 0.9 and 1.1).

In some embodiments, the matrix processor 809 may perform a mathematical algorithm to determine suitable real-valued coefficient values for the decoding approach. A specific example of such is described in the following wherein the algorithm seeks to minimize the overall cross-talk: $|p_{12}|^2+|p_{21}|^2$ under the constraint of $|p_{11}|^21$ and $|p_{22}|^2=1$.

This problem may be solved by a standard multivariate mathematical analysis tools. In particular it is suitable to use Lagrangian multiplier methods, which, for each row vector v of G, translates into a matrix eigenvalue problem of the form $vA=\lambda vB$ with a normalization requirement $q(v)=1$ given by a quadratic form q. The matrices A and B and the quadratic forms q depend on the entries of the complex matrix H.

Below the solution for $v=[g_{11}\ g_{12}]$ is given. It is trivial to also solve $v=[g_{21}\ g_{22}]$ by interchanging the variables $w_1$ and $w_2$ in the solution below. The Lagrange matrices A and B are defined as:

$$A=\begin{bmatrix} \frac{q_2}{3} & -\frac{q_2}{\sqrt{3}} \\ -\frac{q_2}{\sqrt{3}} & 1 \end{bmatrix},$$

$$B=\begin{bmatrix} 1 & -\frac{q_1}{\sqrt{3}} \\ -\frac{q_1}{\sqrt{3}} & \frac{q_1}{3} \end{bmatrix},$$

where $q_1$ and $q_2$ are defined as:

$$q_1=\frac{w_1^2}{1-2w_1+2w_1^2},$$

$$q_2=\frac{w_2^2}{1-2w_2+2w_2^2}.$$

The Eigenvalues are found by:

$$\det(A-\lambda B)=0,$$

which results in the roots of a quadratic polynomial:

$$\lambda_1=\frac{-b+\sqrt{b^2-4ac}}{2a},$$

$$\lambda_2=\frac{-b-\sqrt{b^2-4ac}}{2a}$$

where $$a=\frac{q_1-q_1^2}{3},$$

$$b=\frac{5}{9}q_1\cdot q_2-1,$$

-continued $$c=\frac{q_2-q_2^2}{3}.$$

Now two candidate solutions can be determined:

$$(A-\lambda_{1,2}B)v_{1,2}=\overline{0}$$

The final solution is determined by $v=c_i\cdot v_i$, where i is either 1 or 2 such that $|p_{11}|^2=1$ and with minimal crosstalk. First $c_i$ is calculated as:

$$c_i=1\Big/\sqrt{(1-q_1)v_{i,1}^2+q_1\cdot\left(v_{i,1}-\frac{v_{i,2}}{\sqrt{3}}\right)^2}$$

Then the crosstalk $|p_{12}|^2$ for both solutions is calculated:

$$|p_{12}|^2=q_2c_i^2\cdot\left(\frac{v_{i,1}}{\sqrt{3}}-v_{i,2}\right)^2+(1-q_2)(c_i\cdot v_{i,2})^2$$

The index i that produces the minimum crosstalk gives $v=c_i\cdot v_i$. Without further proof it is stated that independent of the variables $w_1$ and $w_2$, the index i is always equal to 2.

For completeness, the complete solution for G in terms of analytic equations is given below. The following variables are defined:

$$q_1=\frac{w_1^2}{1-2w_1+2w_1^2},$$

$$q_2=\frac{w_2^2}{1-2w_2+2w_2^2},$$

$$s=q_1+q_2,$$

$$p=\frac{q_1q_2}{9}.$$

Then, the variable b is calculated as:

$$b=1-5p-\sqrt{-11p^2+(4s-14)p+1}.$$

Two roots $r_\alpha$ and $r_\beta$ for both rows of the matrix G are calculated as:

$$r_\alpha=\begin{cases} \frac{3b}{2(q_1-q_1^2)}, & \text{if } 0<q_1<1; \\ \frac{q_2-q_2^2}{3(1-5p)}, & \text{if } q_1\in\{0,1\}. \end{cases}$$

$$r_\beta=\begin{cases} \frac{3b}{2(q_2-q_2^2)}, & \text{if } 0<q_2<1; \\ \frac{q_1-q_1^2}{3(1-5p)} & \text{if } q_2\in\{0,1\}. \end{cases}$$

The non-scaled solutions $v_{temp,1}$ and $v_{temp,2}$ can then be determined as:

$$v_{temp,1,1}=1-\frac{q_1r_\alpha}{3},$$

-continued $$v_{temp,1,2} = \frac{q_2 - q_1 r_\alpha}{\sqrt{3}},$$

$$v_{temp,2,2} = 1 - \frac{q_2 r_\beta}{3},$$

$$v_{temp,2,1} = \frac{q_1 - q_2 r_\beta}{\sqrt{3}}.$$

The normalization constants c are calculated as:

$$c_1 = 1 \Big/ \sqrt{(1-q_1)v_{temp,1,1}^2 + q_1 \cdot \left(1 - \frac{q_2}{3}\right)^2},$$

$$c_2 = 1 \Big/ \sqrt{(1-q_2)v_{temp,2,2}^2 + q_2 \cdot \left(1 - \frac{q_1}{3}\right)^2}.$$

Finally, the matrix G is given by:

$$G = \begin{bmatrix} c_1 \cdot v_{temp,1} \\ c_2 \cdot v_{temp,2} \end{bmatrix}.$$

Figure 12:
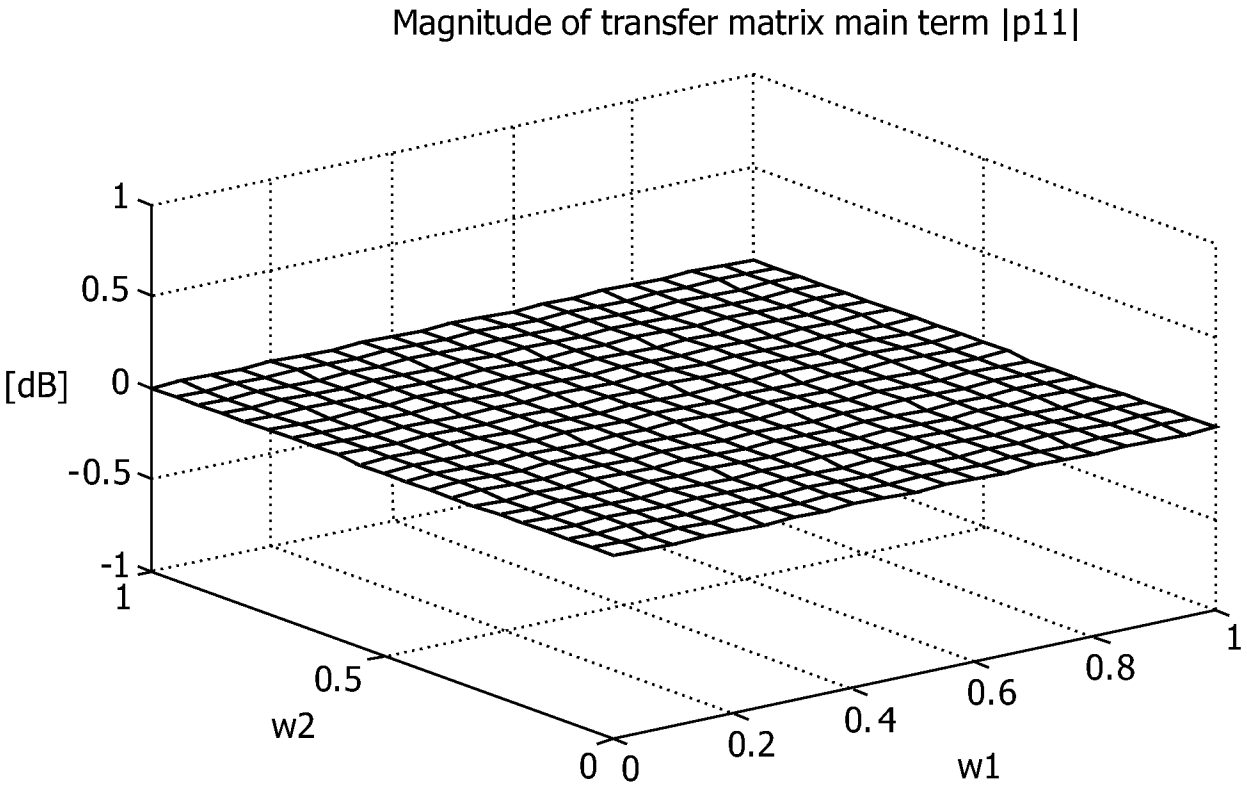
Figure 13:
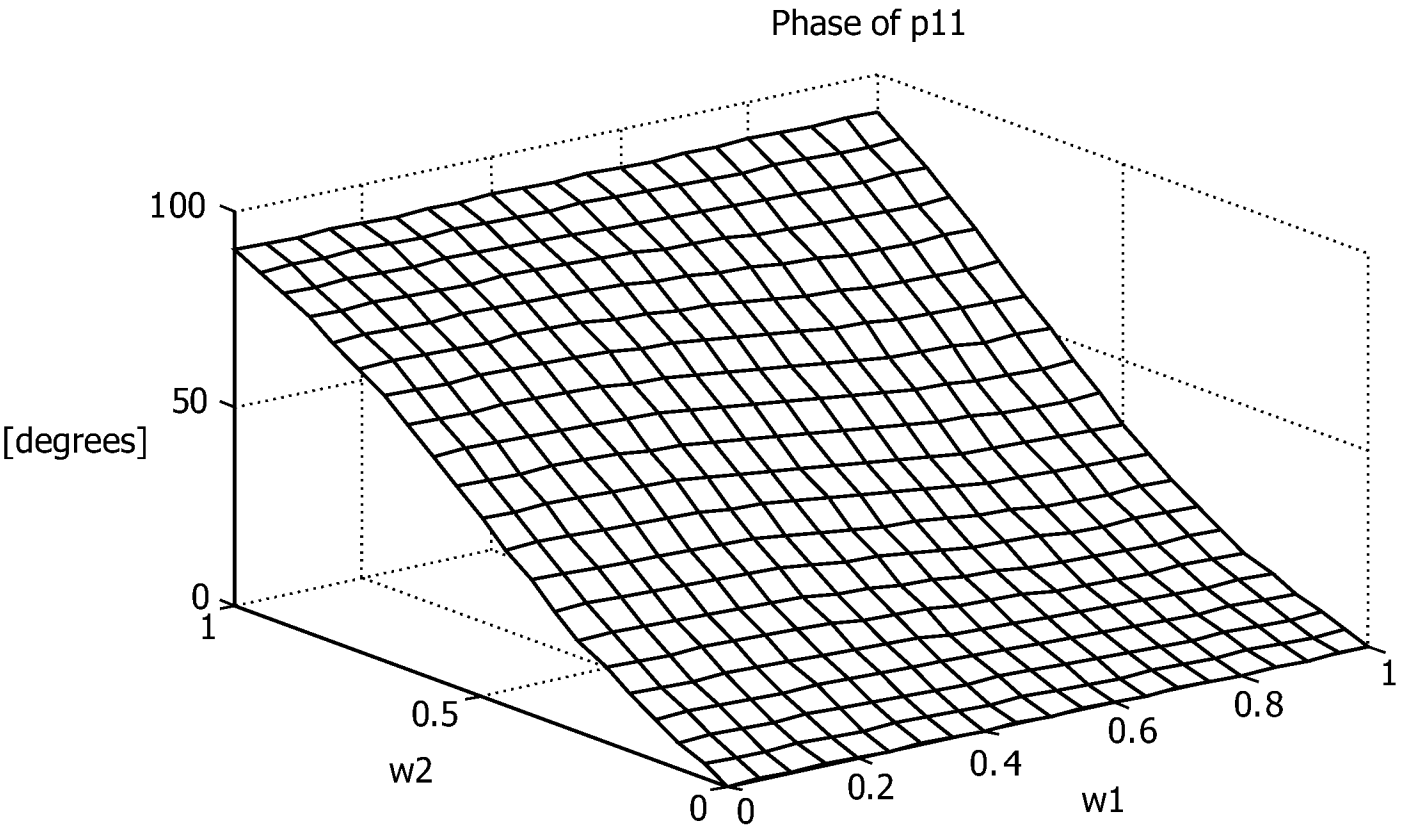
Figure 14:
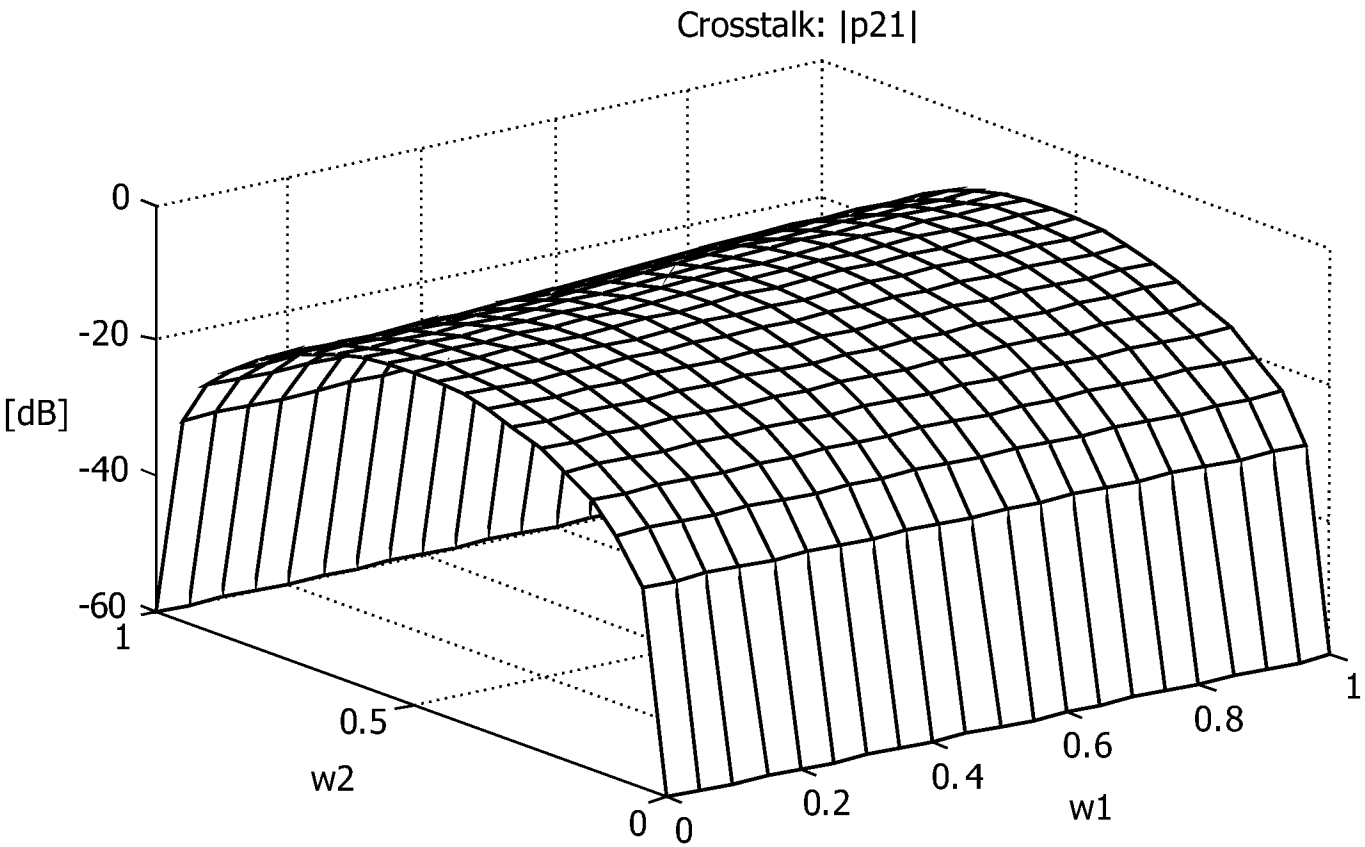

FIGS. 12, 13 and 14 illustrate the performance for this solution. FIG. 12 shows the deviation in dB of the magnitude of the main matrix term $p_{11}$ to the ideal value of $|p_{11}=1$ as a function of $w_1$ and $w_2$. As can be observed, due to the constraints set to this solution, the magnitude is always identical to the ideal value $|p_{11}|=1$.

FIG. 13 shows the angle of $p_{11}$ as a function of $w_1$ and $w_2$. It should be noted that due to the constraints posed by the all real solution also here the phase differences are up to 90 degrees.

FIG. 14 shows the magnitude of the crosstalk matrix term $P_{21}$ measured in dB as a function of weights $w_1$ and $w_2$.

As illustrated by the Figures, the solution of setting the decoding matrix coefficients to the absolute values of the coefficients of the inverse encoding matrix deviates only +/−1 dB from the more intricate approach of minimizing the crosstalk, both in terms of main term gain and crosstalk suppression.

Figure 15:
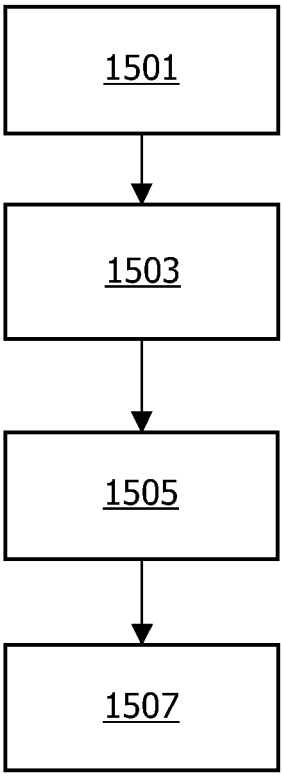
FIG. 15 illustrates a method of decoding in accordance with some embodiments of the invention.

FIG. 15 illustrates a method of audio decoding in accordance with some embodiments of the invention.

In step 1501 a decoder receives input data comprising an N-channel signal corresponding to a down-mixed signal of an M-channel audio signal, M>N, having complex valued subband encoding matrices applied in frequency subbands and parametric multi-channel data associated with the down-mixed signal.

Step 1501 is followed by step 1503 wherein frequency subbands are generated for the N-channel signal. At least some of the frequency subbands are real-valued frequency subbands.

Step 1503 is followed by step 1505 wherein real-valued subband decoding matrices for compensating the application of the encoding matrices are determined in response to the parametric multi-channel data.

Step 1505 is followed by step 1507 wherein down-mix data corresponding to the down-mixed signal is generated by a matrix multiplication of the real-valued subband decoding matrices and data of the N-channel signal in the at least some real-valued frequency subbands.

It will be appreciated that the above description for clarity has described embodiments of the invention with reference to different functional units and processors. However, it will be apparent that any suitable distribution of functionality between different functional units or processors may be used without detracting from the invention. For example, functionality illustrated to be performed by separate processors or controllers may be performed by the same processor or controllers. Hence, references to specific functional units are only to be seen as references to suitable means for providing the described functionality rather than indicative of a strict logical or physical structure or organization.

The invention can be implemented in any suitable form including hardware, software, firmware or any combination of these. The invention may optionally be implemented at least partly as computer software running on one or more data processors and/or digital signal processors. The elements and components of an embodiment of the invention may be physically, functionally and logically implemented in any suitable way. Indeed the functionality may be implemented in a single unit, in a plurality of units or as part of other functional units. As such, the invention may be implemented in a single unit or may be physically and functionally distributed between different units and processors.

Although the present invention has been described in connection with some embodiments, it is not intended to be limited to the specific form set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention. In the claims, the term comprising does not exclude the presence of other elements or steps.

Furthermore, although individually listed, a plurality of means, elements or method steps may be implemented by e.g. a single unit or processor. Additionally, although individual features may be included in different claims, these may possibly be advantageously combined, and the inclusion in different claims does not imply that a combination of features is not feasible and/or advantageous. Also the inclusion of a feature in one category of claims does not imply a limitation to this category but rather indicates that the feature is equally applicable to other claim categories as appropriate. Furthermore, the order of features in the claims do not imply any specific order in which the features must be worked and in particular the order of individual steps in a method claim does not imply that the steps must be performed in this order. Rather, the steps may be performed in any suitable order. In addition, singular references do not exclude a plurality. Thus references to "a", "an", "first", "second" etc do not preclude a plurality. Reference signs in the claims are provided merely as a clarifying example shall not be construed as limiting the scope of the claims in any way.

The invention claimed is:

1. An audio decoder comprising:

receiver for receiving input data comprising an N-channel signal corresponding to a down-mixed signal of an M-channel audio signal, M>N, having complex valued subband encoding matrices applied in frequency subbands and parametric multi-channel data associated with the down-mixed signal;

generator for generating frequency subbands for the N-channel signal, at least some of the frequency subbands being real-valued frequency subbands;

determiner for determining real-valued subband decoding matrices for compensating the application of the encoding matrices in response to the parametric multi-channel data; and generator for generating down-mix data corresponding to the down-mixed signal by a matrix multiplication of the real-valued subband decoding matrices and data of the N-channel signal in the at least some real-valued frequency subbands.

2. The audio decoder of claim 1 wherein the determiner is arranged to determine complex valued subband inverse matrices of the encoding matrices and to determine the decoding matrices in response to the inverse matrices.

3. The audio decoder of claim 2 wherein the determiner is arranged to determine each real-valued matrix coefficient of the decoding matrices in response to an absolute value of corresponding matrix coefficients of the inverse matrices.

4. The audio decoder of claim 3 wherein the determiner is arranged to determine each real-valued matrix coefficient substantially as an absolute value of the corresponding matrix coefficient of the inverse matrices.

5. The audio decoder of claim 1 wherein the determiner is arranged to determine the decoding matrices in response to subband transfer matrices being a multiplication of corresponding decoding matrices and encoding matrices.

6. The audio decoder of claim 5 wherein the determiner is arranged to determine the decoding matrices in response to magnitude measures only of the transfer matrices.

7. The audio decoder of claim 5 wherein the transfer matrices of each subband are given by $$P = \begin{bmatrix} p_{11} & p_{12} \\ p_{21} & p_{22} \end{bmatrix} = G \cdot H = \begin{bmatrix} g_{11} & g_{12} \\ g_{21} & g_{22} \end{bmatrix} \cdot \begin{bmatrix} h_{11} & h_{12} \\ h_{21} & h_{22} \end{bmatrix}$$

where G is a subband decoding matrix and H is a subband encoding matrix and the determineris arranged to select the matrix coefficients $$\begin{bmatrix} g_{11} & g_{12} \\ g_{21} & g_{22} \end{bmatrix}$$

such that a power measure of $p_{12}$ and $p_{21}$ meets a criterion.

8. The audio decoder of claim 7 wherein the magnitude measure is determined in response to $$|p_{12}^2|+|p_{21}^2|$$

9. The audio decoder of claim 7 wherein the determiner is further arranged to select the matrix coefficients under the constraint of a magnitude of $p_{11}$ and $p_{22}$ being substantially equal to one.

10. The audio decoder of claim 1 wherein the down-mixed signal and the parametric multi-channel data is in accordance with an MPEG surround standard.

11. The audio decoder of claim 1 wherein the encoding matrix is an MPEG Matrix Surround Compatibility encoding matrix and the first N-channel signal is an MPEG Matrix Surround Compatible signal.

12. A method of audio decoding, the method comprising: receiving input data comprising an N-channel signal corresponding to a down-mixed signal of an M-channel audio signal, M>N, having complex valued subband encoding matrices applied in frequency subbands and parametric multi-channel data associated with the down-mixed signal;

generating frequency subbands for the N-channel signal, at least some of the frequency subbands being real-valued frequency subbands;

determining real-valued subband decoding matrices for compensating the application of the encoding matrices in response to the parametric multi-channel data; and generating down-mix data corresponding to the down-mixed signal by a matrix multiplication of the real-valued subband decoding matrices and data of the N-channel signal in the at least some real-valued frequency subbands.

13. A receiver for receiving an N-channel signal, the receiver comprising:

receiver for receiving input data comprising an N-channel signal corresponding to a down-mixed signal of an M-channel audio signal, M>N, having complex valued subband encoding matrices applied in frequency subbands and parametric multi-channel data associated with the down-mixed signal;

generator for generating frequency subbands for the N-channel signal, at least some of the frequency subbands being real-valued frequency subbands;

determiner for determining real-valued subband decoding matrices for compensating the application of the encoding matrices in response to the parametric multi-channel data;

generator for generating down-mix data corresponding to the down-mixed signal by a matrix multiplication of the real-valued subband decoding matrices and data of the N-channel signal in the at least some real-valued frequency subbands.

14. A transmission system for transmitting an audio signal, the transmission system comprising:

a transmitter comprising:

generator for generating an N-channel down-mixed signal of an M-channel audio signal, M>N, generator for generating parametric multi-channel data associated with the down-mixed signal, generator for generating a first N-channel signal by applying complex valued subband encoding matrices to the N-channel down-mixed signal in frequency subbands, generator for generating a second N-channel signal comprising the first N-channel signal and the parametric multi-channel data, and transmitter for transmitting the second N-channel signal to a receiver; and the receiver comprising:

receiver for receiving the second N-channel signal, generator for generating frequency subbands for the first N-channel signal, at least some of the frequency subbands being real-valued frequency subbands, determiner for determining real-valued subband decoding matrices for compensating the application of the encoding matrices in response to the parametric multi-channel data, and generator for generating down-mix data corresponding to the N-channel down-mixed signal by a matrix multiplication of the real-valued subband decoding matrices and data of the N-channel signal in the at least some real-valued frequency subbands.

15. A method of receiving an audio signal, the method comprising:

at a receiver, receiving input data comprising an N-channel signal corresponding to a down-mixed signal of an M-channel audio signal, M>N, having complex valued subband encoding matrices applied in frequency subbands and parametric multi-channel data associated with the down-mixed signal;

generating frequency subbands for the N-channel signal, at least some of the frequency subbands being real-valued frequency subbands;

determining real-valued subband decoding matrices for compensating the application of the encoding matrices in response to the parametric multi-channel data; and generating down-mix data corresponding to the down-mixed signal by a matrix multiplication of the real-valued subband decoding matrices and data of the N-channel signal in the at least some real-valued frequency subbands.

16. A method of transmitting and receiving an audio signal, the method comprising:

at a transmitter performing:

generating an N-channel down-mixed signal of an M-channel audio signal,

M>N, generating parametric multi-channel data associated with the down-mixed signal, generating a first N-channel signal by applying complex valued subband encoding matrices to the N-channel down-mixed signal in frequency subbands, generating a second N-channel signal comprising the first N-channel signal and the parametric multi-channel data, and transmitting the second N-channel signal to a receiver; and at the receiver performing:

receiving the second N-channel signal, generating frequency subbands for the first N-channel signal, at least some of the frequency subbands being real-valued frequency subbands, determining real-valued subband decoding matrices for compensating the application of the encoding matrices in response to the parametric multi-channel data, generating down-mix data corresponding to the N-channel down-mixed signal by a matrix multiplication of the real-valued subband decoding matrices and data of the N-channel signal in the at least some real-valued frequency subbands.

17. A non-transitory computer-readable storage medium having stored thereon a computer program, which when executed by a processor performs a method of audio decoding, the method comprising:

receiving input data comprising an N-channel signal corresponding to a down-mixed signal of an M-channel audio signal, M>N, having complex valued subband encoding matrices applied in frequency subbands and parametric multi-channel data associated with the down-mixed signal;

generating frequency subbands for the N-channel signal, at least some of the frequency subbands being real-valued frequency subbands;

determining real-valued subband decoding matrices for compensating the application of the encoding matrices in response to the parametric multi-channel data; and generating down-mix data corresponding to the down-mixed signal by a matrix multiplication of the real-valued subband decoding matrices and data of the N-channel signal in the at least some real-valued frequency subbands.

18. A non-transitory computer-readable storage medium having stored thereon a computer program, which when executed by a processor performs a method of receiving an audio signal, the method comprising:

receiving input data comprising an N-channel signal corresponding to a down-mixed signal of an M-channel audio signal, M>N, having complex valued subband encoding matrices applied in frequency subbands and parametric multi-channel data associated with the down-mixed signal;

generating frequency subbands for the N-channel signal, at least some of the frequency subbands being real-valued frequency subbands;

determining real-valued subband decoding matrices for compensating the application of the encoding matrices in response to the parametric multi-channel data; and generating down-mix data corresponding to the down-mixed signal by a matrix multiplication of the real-valued subband decoding matrices and data of the N-channel signal in the at least some real-valued frequency subbands.

19. A non-transitory computer-readable storage medium having stored thereon a computer program, which when executed by a processor performs a method of transmitting and receiving an audio signal, the method comprising:

at a transmitter performing:

generating an N-channel down-mixed signal of an M-channel audio signal, M>N, generating parametric multi-channel data associated with the down-mixed signal, generating a first N-channel signal by applying complex valued subband encoding matrices to the N-channel down-mixed signal in frequency subbands, generating a second N-channel signal comprising the first N-channel signal and the parametric multi-channel data, and transmitting the second N-channel signal to a receiver; and at the receiver performing:

receiving the second N-channel signal, generating frequency subbands for the first N-channel signal, at least some of the frequency subbands being real-valued frequency subbands, determining real-valued subband decoding matrices for compensating the application of the encoding matrices in response to the parametric multi-channel data, generating down-mix data corresponding to the N-channel down-mixed signal by a matrix multiplication of the real-valued subband decoding matrices and data of the N-channel signal in the at least some real-valued frequency subbands.

20. An audio playing device comprising an audio decoder comprising:

receiver for receiving input data comprising an N-channel signal corresponding to a down-mixed signal of an M-channel audio signal, M>N, having complex valued subband encoding matrices applied in frequency subbands and parametric multi-channel data associated with the down-mixed signal;

generator for generating frequency subbands for the N-channel signal, at least some of the frequency subbands being real-valued frequency subbands;

determiner for determining real-valued subband decoding matrices for compensating the application of the encoding matrices in response to the parametric multi-channel data; and generator for generating down-mix data corresponding to the down-mixed signal by a matrix multiplication of the real-valued subband decoding matrices and data of the N-channel signal in the at least some real-valued frequency subbands.

* * * * *